US005619584A

United States Patent [19]

Lin

[11] Patent Number: 5,619,584

[45] Date of Patent: Apr. 8, 1997

[54] HEADPHONE

[75] Inventor: Teng K. Lin, Kaohsiung, Taiwan

[73] Assignee: Califone International Inc., Chatsworth, Calif.

[21] Appl. No.: 565,790

[22] Filed: Dec. 1, 1995

[51] Int. Cl.[6] ..... H04R 25/00

[52] U.S. Cl. ..... 381/183; 381/187

[58] Field of Search ..... 381/183, 187, 381/25; 181/129, 137; 379/430

[56] References Cited

U.S. PATENT DOCUMENTS 4,490,593 2/1985 Antle ..... 381/183

FOREIGN PATENT DOCUMENTS 2103902 2/1983 United Kingdom ..... 381/183

OTHER PUBLICATIONS

Califonc international, Inc. Info. Sht., 292AV Dynamic Headphone, 1992, 2pp. mpc–pm & e Educational Systems, Inc. Info. Sht., MPC–2900 Series Dynamic Headphones, 1 pg.

mpc–pm & e Educational Systems, Inc. Info. Sht., Durable Headphones Designed for Institutional Use, 1994, 1 pg.

Califone International, Inc. Info. Sht., Listening Center Components, 1990, 1 pg.

Califone International, Inc. Info. Sht., 2924AV Headphone, 1991, 1 pg.

mpc–pm & e Educational Systems, Inc. Info. Sht., MPC–2900 Series Dynamic Headphones, ("NEW"), 1 pg.

mpc–pm & e Educational Systems, Inc. Info. Sht., . . . And student Record, 1 pg.

mpc–pm & e Educational Systems, Inc., Info. Sht., Durable–Dynamic Headphones Designed for Institutional Use, 1991, 1 pg.

mpc–pm & e Educational Systems,, Inc. Info. Sht., MPC Listening Centers with MPC–MX300 (H/99) Dynamic Headphones.

mpc–pm & e Educational Systems, Inc. Info. Sht., New MPC–2900 Series Listening Centers.

mpc–pm & e Educational Systems, Inc. Info. Sht., MPC–PM&E Listening Centers with H/88 Deluxe Headphones.

mpc–pm & e Educational Systems, Inc. Info. Sht., MPC Listening Centers With . . . Headphones.

Catalog entitled Headphones & Headsets, pp. 395–402.

Yamaaha YH–1/2/3, "Now Lower Distortion and Wider Frequency Response With Yamaha's Exclusive Orthodynamic Headphone Design" Apr. 1983.

*Primary Examiner*—Sinh Tran

*Attorney, Agent, or Firm*—Pretty, Schroeder, Brueggemann & Clark

[57] ABSTRACT

A headphone having ear pieces joined by a head band with an electrical cable interconnecting the ear pieces, including a first plurality of outward opening grooves in the head band and a second plurality of inward opening grooves in the head band, with the first and second grooves alternately positioned along the head band defining a path for the electrical cable between the ear pieces. Preferably the grooves are formed integrally with the head band, with the portions of the head band forming the grooves projecting from the head band with the grooves in alignment with each other. The headphone may also include a comfort sling underlying the head band and connected at each end to the head band.

4 Claims, 2 Drawing Sheets

FIG. 1
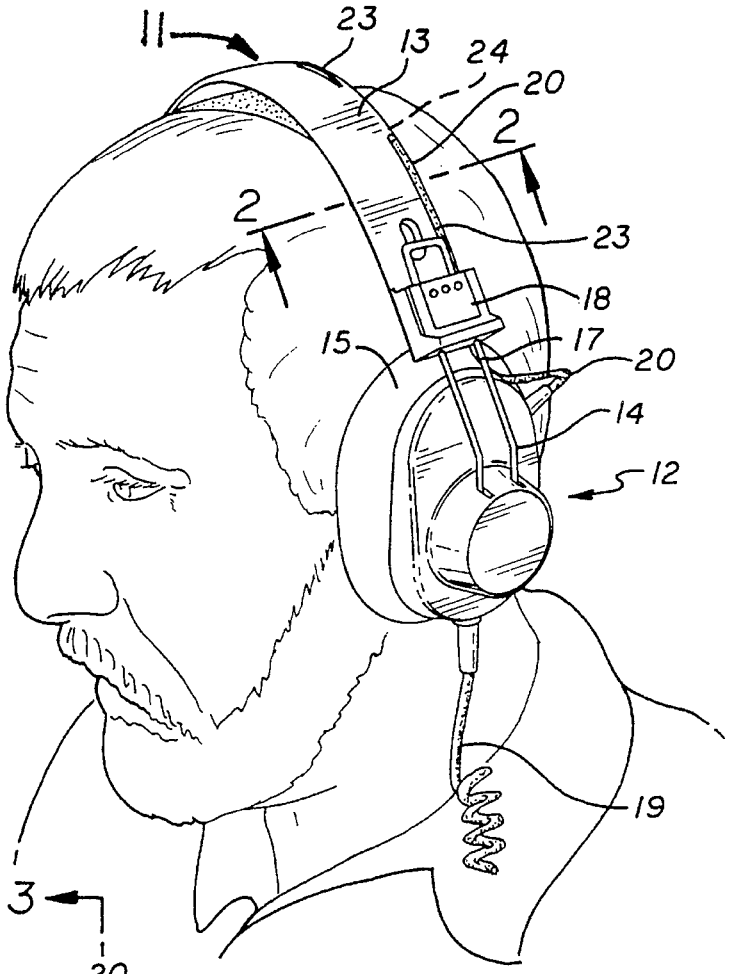
FIG. 2
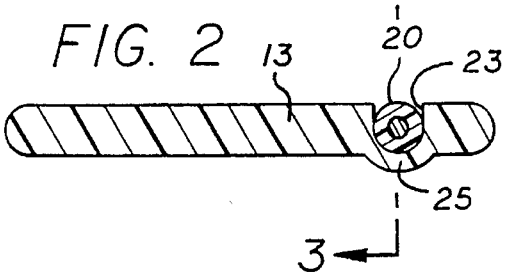
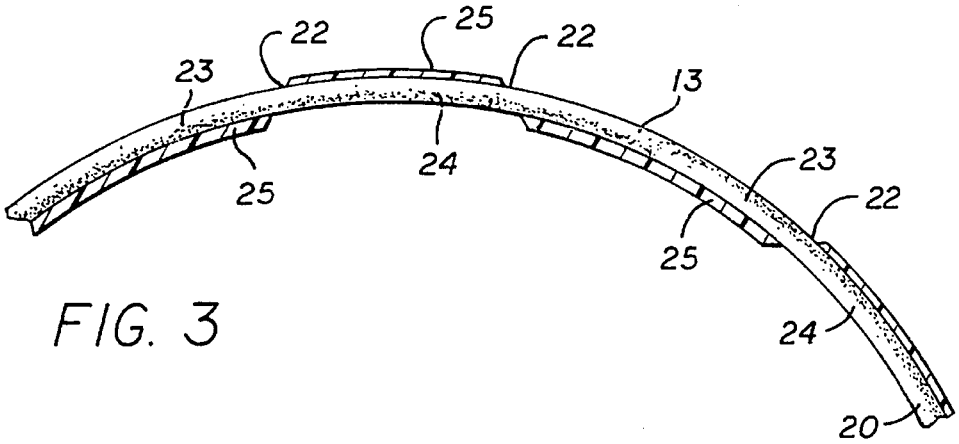
FIG. 3

HEADPHONE

BACKGROUND OF THE INVENTION

This invention relates to headphones, which have been in use since the early days of radio. A typical headphone includes two ear pieces joined by a head band, with a speaker in each ear piece. An electrical cable interconnects the two earphones and also connects them to the source, such as an amplifier which drives the speakers.

For those who wear headphones for long periods of time, comfort is a desirable feature, and present day ear pieces typically comprise a shell with the electrical components and an ear muff which fits closely on the side of the head around the ear. The shells typically are carried on one or more support rods which slide in the ends of the head band to provide adjustments of the ear pieces with respect to the head band.

Another requirement is the electrical cable running between the ear pieces, which cable typically is attached to the head band or lies in a groove in the head band. However, a problem is sometimes encountered with the electrical cable becoming loose and/or entangled with other parts. This is typically a problem when the conventional U-shaped head band is spread out or opened to a more flat condition when placing it on the head or removing it from the head or doing some adjustments or service work, and when the distance between the ear pieces at the ends of the head band is increased. The length of the electrical cable required to follow the original arc is longer than the distance between the ends of the head band. Under these circumstances the cable may lift out of the groove and may be easily picked out of the groove with a pointed instrument or a fingernail.

Headphones may also include a comfort sling connected at its ends to be positioned within the head band, with the head band providing the mechanical strength and positioning for the headphone, and with the comfort sling fitting closely to the user's head for increased comfort when wearing the headphone.

It is an object of the present invention to provide a new and improved head band for a set of earphones which head band will receive and retain the electrical cable while at the same time being inexpensive and easy to manufacture and use.

It is another object of the invention to provide a headphone with a new and improved comfort sling construction, including the attachment of the sling to the head band.

Other objects, advantages, features and results will more fully appear in the course of the following description.

SUMMARY OF THE INVENTION

The problem with the potentially loose electrical cable along the head band is met by providing for weaving the cable through openings in the head band for alternately positioning the cable on opposite surfaces of the head band.

The preferred embodiment of the invention comprises a headphone having ear pieces joined by a head band with an electrical cable interconnecting the ear pieces, a first plurality of outward opening grooves in the head band and a second plurality of inward opening grooves in the head band, with the first and second grooves alternately positioned along the head band defining a path for the electrical cable between the ear pieces. Preferably the grooves are formed integrally with the head band, with the portions of the head band forming the grooves projecting from the head band with the grooves in alignment with each other.

The headphone may include a comfort sling underlying the head band and connected at each end to the head band. A connector for joining the comfort sling and head band at aligned openings may include a first member with head and body, with the body of a size to pass through the aligned openings and having resilient ends of a size larger than the head band opening and compressible to pass through the head band opening, and a second member with a plate and a stepped opening with one step of a size to receive the body and with a second larger step of a size to receive the ends of the body.

BRIEF DESCRIPTION OF THE DRAWINGS

FIG. 1 is a perspective view illustrating a headphone on a user's head, and incorporating the presently preferred embodiment of the invention;

FIG. 2 is an enlarged sectional view taken along the line 2—2 of FIG. 1;

FIG. 3 is an enlarged sectional side view of a portion of the head band of FIG. 1 taken along line 3—3 of FIG. 2;

DESCRIPTION OF THE PREFERRED EMBODIMENT

Figure 4:
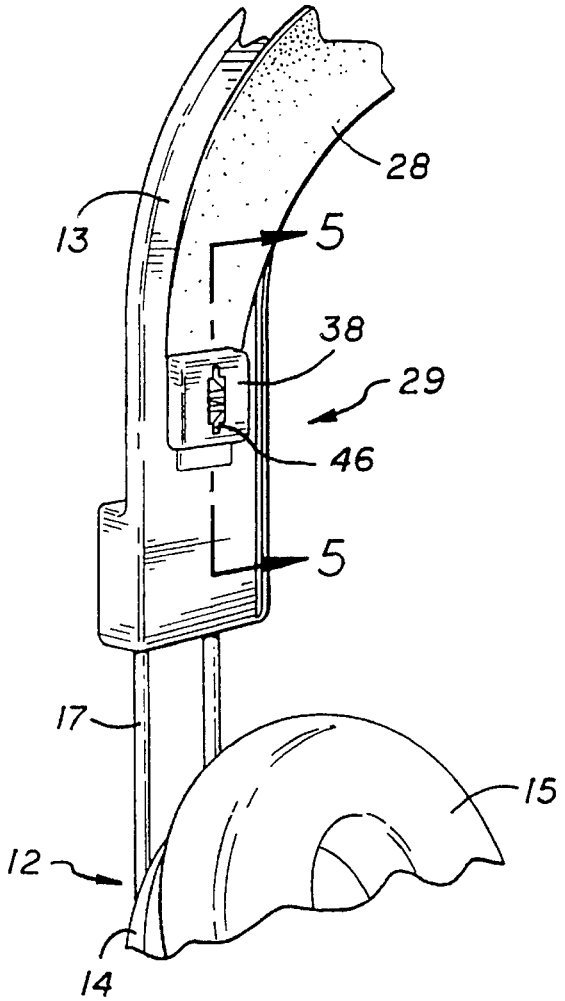
FIG. 4 is an enlarged perspective view of a portion of the headphone illustrating the attachment of the comfort sling to the head band.

The headphone 11 as seen in FIG. 1 includes an ear piece 12 and a head band 13. The ear piece includes a shell 14 and an ear muff 15. A wire loop 17 is carried in the ear piece and slides in an end portion 18 of the band for adjusting the position of the ear piece with respect to the head band.

The ear piece is connected by an electrical cable 19 to a source, and is also connected to the opposite ear piece at the other end of the head band by another electrical cable 20 carried in the head band.

Openings 22 are provided along the head band 13 for weaving the cable 20 along the head band, alternating between the opposite surfaces of the head band as seen in FIGS. 2 and 3. Preferably a first set of outwardly opening grooves 23, and a second set of inwardly opening grooves 24 are provided in the head band 13. Preferably, the head band is a molded plastic piece with the grooves molded in position, and each groove will have a bulge 25 or projecting portion which permits the cable 20 to be positioned in the groove while not extending above the surface of the head band.

The grooves 23, 24 are positioned alternately along the head band extending between the ear pieces, with the grooves in alignment with each other so that there is no bending of the cable at the transition from one groove to the adjacent groove.

Figure 5:
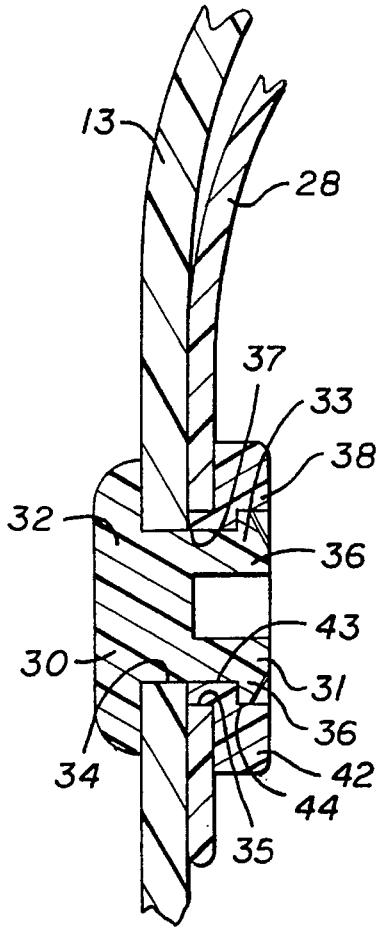
FIG. 5 is an enlarged partial sectional view taken along the line 5—5 of FIG. 4.

Preferably a comfort sling 28 is positioned below the head band 13 for improved comfort for the wearer as seen in FIGS. 3–5. The comfort sling is attached at each end to the head band, by a connector 29 which has a first member 30 and a second member 38. The first member 30 has a head 32 and a body 33, with the body of a size to pass through openings 34, 35 in the head band and comfort sling, respectively. The body has resilient ends 36 which may be compressed toward each other for passing through the opening 34 in the head band and an opening 37 in a second member 38 of the connector. Preferably, the outer ends of the fingers 36 are tapered, as seen in FIG. 5, for ease of pushing the second member 38 over the ends. The second member 38 is in the form of a plate 42 with stepped openings, comprising an inner opening 43 of a size to receive the body of the first member, and with a second opening 44 of a size to receive the outer ends of the body when in their normal position.

The connector may be assemblied with the head band and comfort sling by positioning the second member in an opening in the comfort sling and then placing the comfort sling in position against the head band. Then the first member 32 is pushed through the opening in the head band and through the opening in the second member, with the resilient ends being compressed toward each other until they pass into the larger opening 44, at which time they expand to the rest position shown in FIG. 5.

This construction makes it easy to assemble the comfort sling in the head band. Also, by providing slots 46 in the plate 42, the connector can be disassembled by applying compression forces at the slots 46 to the resilient ends and while the ends are compressed together, pushing the first member out of the second member.

I claim:

1. In a headphone having ear pieces joined by a head band with an electrical cable interconnecting the ear pieces, said head band being a single U-shaped member having an inner surface and an outer surface, the improvement comprising:

a first plurality of outward opening grooves in said outer surface of said head band and a second plurality of inward opening grooves in said inner surface of said head band, with said first and second grooves alternately positioned along said head band defining a path for the electrical cable between the ear pieces, with said cable in said first and second grooves of said path alternately at said outer surface of said headband and said inner surface of said headband.

2. A headphone as defined in claim 1 wherein said first and second grooves are formed integrally with said head band, with the portions of the head band forming the first and second grooves projecting from the head band with the first and second grooves in alignment with each other defining a uniform continuous path for said cable.

3. A headphone as defined in claim 2 including a comfort sling underlying said head band and connected at each end of said comfort sling to said head band.

4. In a headphone having ear pieces joined by a head band with an electrical cable interconnecting the ear pieces, the improvement comprising:

a first plurality of outward opening grooves in said head band and a second plurality of inward opening grooves in said head band, with said first and second grooves alternately positioned along said head band defining a path for the electrical cable between the ear pieces, said first and second grooves being formed integrally with said head band, with the portions of the head band forming the first and second grooves projecting from the head band with the first and second grooves in alignment with each other;

a comfort sling underlying said head band connected at each end of said comfort sling to said head band; said comfort sling and said headband having aligned openings and a connector for joining said comfort sling and said head band at said aligned openings, said connector comprising:

a first member with head and body, said body of a size to pass through said aligned openings and having resilient ends of a size larger than said head band opening and compressible to pass through said head band opening; and a second member with a plate and a stepped opening with one step of a size to receive said body and with a second larger step of a size to receive said ends of said body.

* * * * *